US005833336A

United States Patent [19]

Dean

[11] Patent Number: 5,833,336

[45] Date of Patent: Nov. 10, 1998

[54] PARTITIONED STYLISH HAMPER

[76] Inventor: W. Anthony Dean, 104 Buckley Pl., Henrietta, N.Y. 14467

[21] Appl. No.: 912,390

[22] Filed: Aug. 18, 1997

[51] Int. Cl.[6] ..... B65D 90/04; A47B 97/00

[52] U.S. Cl. ..... 312/293.2; 312/351; 220/404; 220/DIG. 909

[58] Field of Search ..... 312/351, 290, 312/249.8, 249.11, 293.1, 293.2, 327, 328; 220/404, 403, 462, 909

[56] References Cited

U.S. PATENT DOCUMENTS

| | | | |
|---|---|---|---|
| D. 303,858 | 10/1989 | Coleman . | |
| 1,556,007 | 10/1925 | Murphy et al. | 312/293.2 |
| 2,868,606 | 1/1959 | Stierna | 312/293.2 |
| 2,895,782 | 7/1959 | Fragale | 312/290 |
| 4,057,309 | 11/1977 | Fragale | 312/290 |
| 4,418,930 | 12/1983 | Ryan, Jr. | 280/47.19 |
| 4,585,283 | 4/1986 | Redmon et al. . | |
| 4,642,934 | 2/1987 | Carlson et al. | 220/404 X |
| 5,050,768 | 9/1991 | Alden | 220/909 X |
| 5,102,208 | 4/1992 | Joynes et al. . | |
| 5,118,173 | 6/1992 | Proctor et al. . | |
| 5,244,268 | 9/1993 | Derrickson | 312/293.2 X |
| 5,398,836 | 3/1995 | Dosunmu | 220/404 |
| 5,411,165 | 5/1995 | Ellis | 220/404 |
| 5,478,152 | 12/1995 | Bogle | 220/404 X |
| 5,544,781 | 8/1996 | Mattesky | 220/404 |
| 5,690,217 | 11/1997 | Friday | 220/909 |

*Primary Examiner*—Jose V. Chen
*Assistant Examiner*—Hanh Van Tran
*Attorney, Agent, or Firm*—Patent & Trademark Services; Thomas Zack; Joseph H. McGlynn

[57] ABSTRACT

A clothes hamper apparatus having removable interior partitions and removable mesh clothing bags. Each partition has vertical edges members which are shaped to engage slots in a track system located on the hamper's walls or on another partition which it is engages. Hoop and loop or VELCRO™ fastener elements are located on mesh bags inserted into the hamper's interior and the walls of the partitions and the hamper to releasable retain the bag and their clothing contents in place within the hamper. The number of partitions and formed compartments within the hamper can be customized based on the placement of number of tracks in the track system to permit a number of mesh bags to be used one in each compartment.

3 Claims, 2 Drawing Sheets

FIG. 2
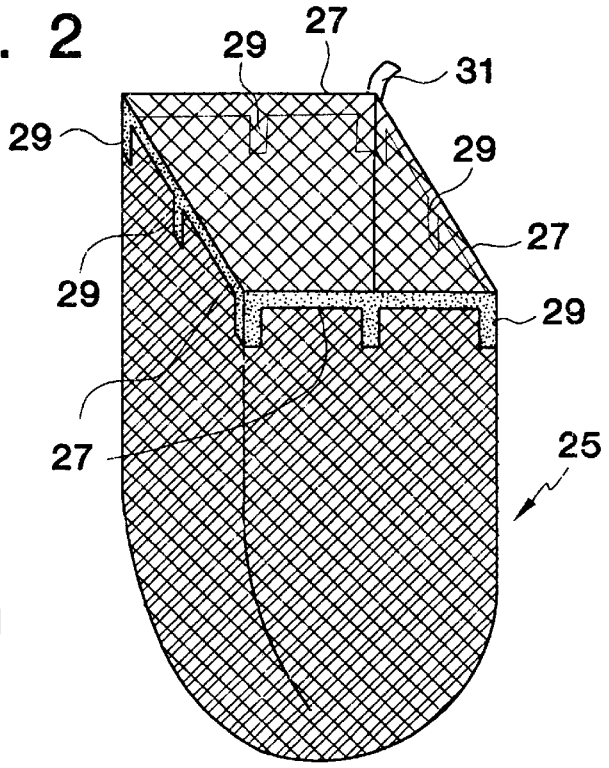
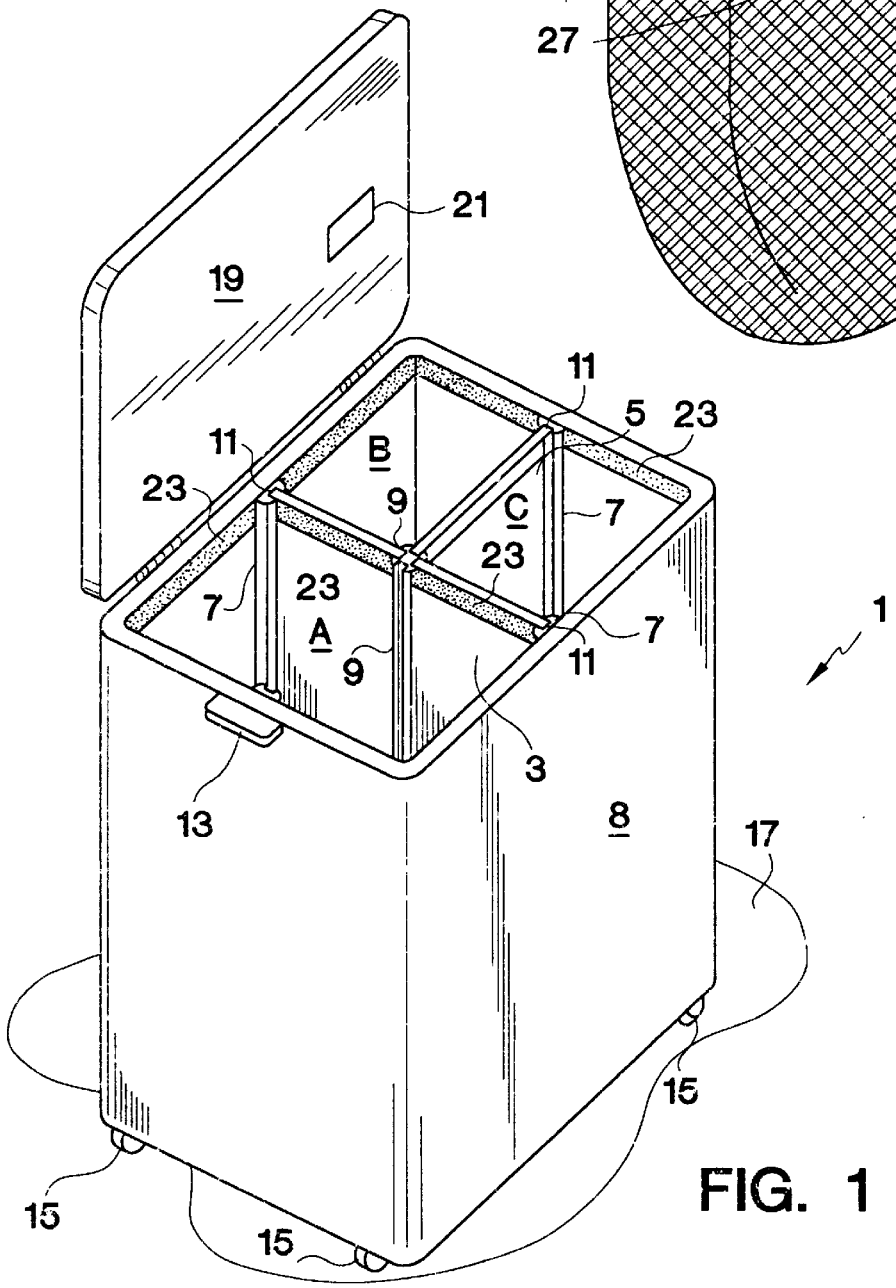
FIG. 1

PARTITIONED STYLISH HAMPER

BACKGROUND OF THE INVENTION

Clothes hampers have been used for years to store soiled clothing prior to its washing. Since, certain clothing items of different color or material fabrics, or both, should be washed differently in different washing load cycles, it is desirable that the clothing be separated accordingly before washing to insure that the colors or material fabrics for a given wash load are washed together at the same time. This clothes selectivity has been provided for by using a plurality of individually removable inner hamper bags located in different box-like partitions within the hamper. In other hampers, external clothes bags are attached to opposite sides of the main clothes container to permit the selective sorting of the different colored clothing or fabrics before they are placed within the washing machine. Still another invention describes a laundry hamper used to support several laundry baskets and a soaking tub with a drain valve to discharge the excess moisture from drying clothes.

The present invention relates to clothes hamper having removable partitions that can be used to selectively change the number and corresponding size of hamper compartments along with removable bags for each compartment as described in this specification.

DESCRIPTION OF THE PRIOR ART

Box-like hampers used to store soiled clothing prior to washing are well known. Some such hampers have been designed to resemble furniture on their exterior surface (e.g., Des. 303,858 to Coleman). When it is desirable to separate several items of soil clothing according to their size, color, fabric, moisture content, etc., partitions either internally or externally of the hamper have been used. For example, in U.S. Pat. No. 4,585,283 to Redmon et al. several individually removable inner hamper bags are disclosed within a box-like hamper. In the U.S. Pat. No. 5,102,208 to Joynes et al., a clothes container is described having two opposite external clothes bags at its opposite ends. And in the Proctor et al. reference (U.S. Pat. No. 5,118,173) a laundry hamper is disclosed having removable baskets that can be used as soaking tub or to permit the drainage or moisture to a lower hamper drain valve. The present invention improves on such inventions by providing for a hamper with removable partitions and bags which can be customized to vary the total number and size of the partitions while permitting the easy removable of the hanging bags therefrom as more further set forth in this specification.

SUMMARY OF THE INVENTION

This invention relates to a clothing hamper having removable partitions and clothing bags which may be customized to change the size and number of hamper compartments formed by the partitions.

It is the primary object of the present invention to provide for an improved clothing hamper.

Another object is to provide for such a hamper wherein the number and size of the formed hamper compartments may be varied by removing or inserting partitions in the hamper.

These and other objects and advantages of the present invention will become apparent to readers from a consideration of the ensuing description and the accompanying drawings.

BRIEF DESCRIPTION OF THE DRAWINGS

FIG. 1 is a side perspective view of the invention's preferred embodiment hamper with two partitions in place.

FIG. 2 is a side perspective view of a mesh bag insert which can be hung in the formed compartments in the FIG. 1 embodiment.

DESCRIPTION OF THE PREFERRED EMBODIMENT

Figure 4:
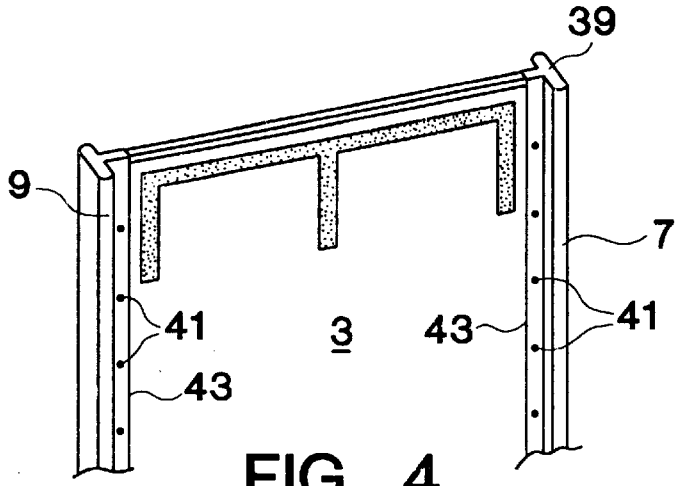
FIG. 4 shows a front view of one of the hamper's removable partitions.

FIG. 1 is a side perspective view of the invention's preferred embodiment hollow interior hamper 1 with two different planar rectangular partitions 3 and 5 in place. The box-like hamper is formed by a solid lower floor, four joined ventilated side panels plus an openable and closable top cover.

Each inserted flat partition engages tracks at two of its vertical edges which tracks are located either along the vertical interior sides sides of the hollow hamper 1, such as the tracks designated by the number 7, or along the vertical sides of a partition as designated by the number 9. For example, the larger partition 3 extends completely across the interior width of the hamper and has two vertical tracks 9 attached to it appropriately at its midsection on opposite sides while it has track engaging members 11 at both of its partition vertical edge ends to engage the vertical tracks 7 fixed to the interior walls of the hamper.

Once the hollow interior is partitioned, several clothing storage compartments are formed within the interior hamper, here three shown, for receiving soiled clothes. In this figure the A has designated at the largest volume compartment with B and C being smaller formed compartments with each having approximately the same volume size. Clearly, if four separate compartments were desired an additional partition could simply be inserted from above and slide down the track 7 located adjacent the hamper handle 13 on one of its edges while its other edge engages the vertical mid-partition track 9 on the large in-place partition.

Also shown in FIG. 1, a three of the four lower wheels 15 used to move the hamper about along the floor 17. A hinge mounted top hamper cover 19 is shown opened to reveal plastic slot holders 21 into which data can be inserted on paper strips designating the particular contents for the formed partitioned compartments, e.g., delicate fabrics, whites, colored clothing, etc. Extending along the interior upper peripheral upper edge of the opened hamper and across the upper edges of the partitions are one of the strip elements of a hook and loop (VELCRO™) fastener 23. It is intended that this fastener element fixed either to the partition upper edge or hamper upper interior edge engage a complimentarily fastener element on a mesh bag to hold the bag in a hanging position when inserted into one of the formed compartments.

FIG. 2 is a side perspective view of a mesh bag insert 25 which can be hung within each of the formed hamper compartments in the FIG. 1 embodiment. Each such bag is used to hold and transport clothing to be washed and is made of a mesh material such as nylon which permits the circulation of air to the clothing within its contents. The bags length is slightly less than the distance from the upper rim of the hamper to the hamper's floor to insure it will hang within its designated compartment. Extending around the upper perimeter of the bag 25 is a complementary hook or loop fastener stiff strip element whose purpose is to engage the each strip fastener hook or loop element 23 on the hamper or partition to removably fasten the bag's upper edge to the hamper or partition.

About midway along the strips 27 length and where it meets at the hamper's four corners, is a vertical disposed longer strip section 29 on the outside of the bag made of the same hook or loop material as the strip 27. At one corner of each bag is a small upwardly extending tab 31 whose purpose it to permit easy gripping of the in-place bag 25 and pulling it upward when the bag's detachment from the hamper's compartment is desired.

Figure 3:
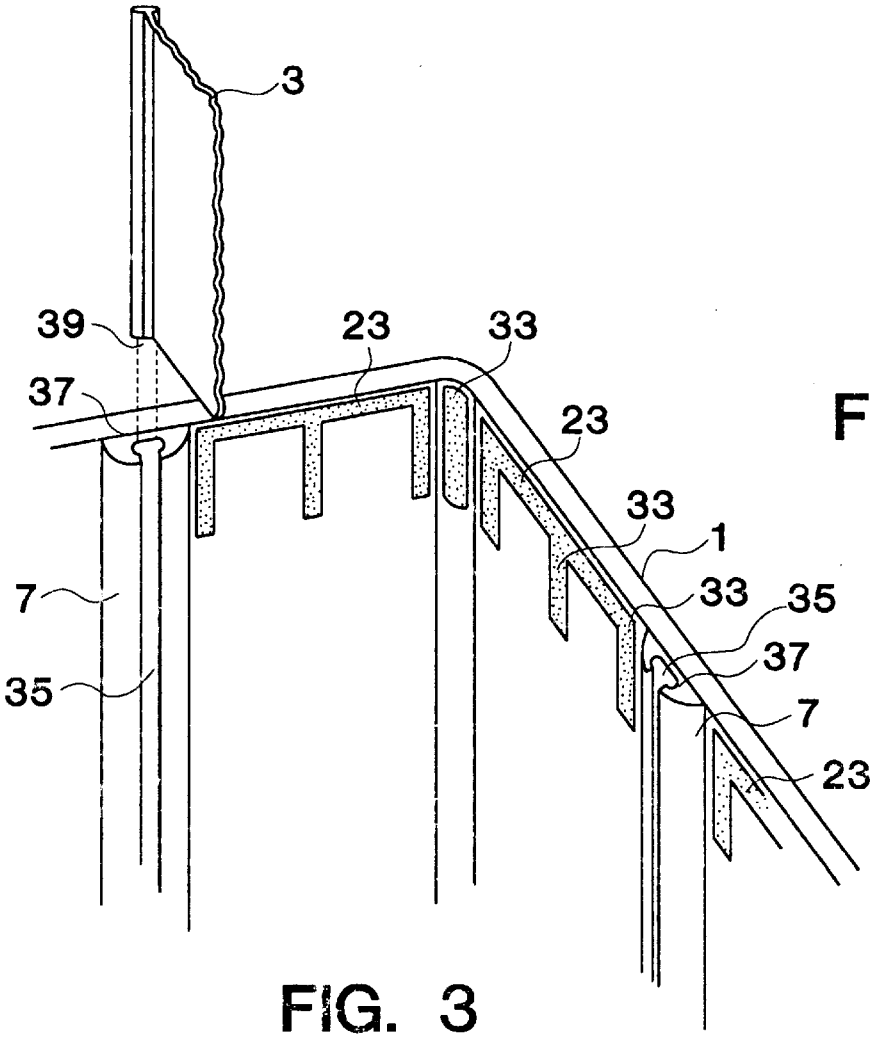
FIG. 3 shows a side view of the hamper's interior corner with a sectional view of a partition.

FIG. 3 shows a side view of the hamper's interior corner with a sectional view of a partition. The hook or loop fastener strip 23 is shown to have downwardly extending vertical strips 33 placed to engage the complimentarily placed vertical hook or loop fastener strips 29 on the clothing bag 25. The vertical length hook and loop fasteners 29 and 33 are used to insure that the mesh bag will not be pulled off the hamper wall or partition when soiled clothes are pushed in the bag.

The soft side of the strip 23 and 33 are bonded to the interior of the hamper and partitions or may be held thereon by any suitable fastening means such as glue, rivets, screws, etc. In this view greater detail is shown on the vertical partition tracks 7. Each such track, whether on the partition or hamper wall, has an opened center slot 35 and an enlarged greater and deeper bell shaped end slot 37 which extends the total vertical length of the track. As shown, this engaged track end 37 is shaped and sized to receive a slightly smaller but same cross sectional shaped edge 39 on the partition 3 (a corner section of which is shown) which is being inserted into the slot from above. This engagement insures that the partition may only removed from its track by lifting the partition upwardly when the hamper's top is opened.

FIG. 4 shows a front view of one of the hamper's removable partitions in place within the track system. Both end vertical edges 39 have been slide into the opposing tracks 7 and 9 located on the hamper's interior wall and upper edge of a partition, respectively. A series of spaced rivets 41 located along a depending bracket flange edge 43 may be used to fasten the partition's vertical edge to each side of the partition.

Figure 5:
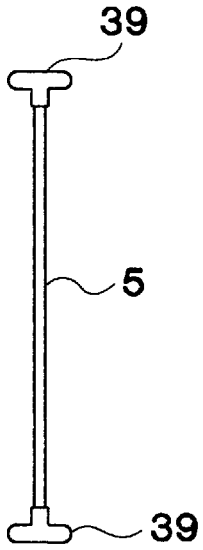
FIG. 5 shows a top cross sectional view of one of the hamper's removable partitions.

FIG. 5 shows a top cross sectional view of one of the hamper's removable partitions and its enlarged edges that engages the tracks on the hamper walls or a partition. Opposite enlarged vertically disposed ends 39 are sized and shaped to engage the tracks enlarged similarly shaped vertical edges 37 to permit its retention is a slid able manner within the track.

Clearly, the number and location of the vertical tracks in the hamper and the partitions could vary to accommodate a different number or size of partitions within the hollow interior of the hamper. For example, on one side of the hamper there could be two vertical tracks on a partition and two vertical tracks on a hamper wall to divide that side of the hamper into three compartments while the other side has only two formed compartments. Other combinations of tracks and partitions used to form other numbers of compartments are also possible.

The hamper may be made of a rigid plastic, rubber or wicker material with an appropriate decorative outer surface and color to suit the taste of a user. It should be ventilated to prevent the retention of odors and allow moisture to escape from the stored clothing. The hamper's wheels and handle can be made of rubber or plastic by the injection molding process. Other materials such as polyester or natural fibers could be used for the nylon mesh clothing bag.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A clothes hamper apparatus comprising:

a hollow interior clothing hamper having four side walls, a bottom and an openable top;

a vertically disposed track system mounted on two side walls of the hamper within the hamper's interior for slidably receiving a removable partition;

a first removable partition adapted to be slidably fit on said track system mounted to the side walls within the hollow interior of the hamper, said first partition when fitted into the track system forming two compartments within the hollow interior of the clothing hamper;

a mesh bag removably inserted into one of the compartment s formed within the hamper, said mesh bag having an upper perimeter edge with both vertical and horizontal hook and loop strip fasteners thereon; and hook and loop strip fasteners extending both horizontally and vertically along the interior upper peripheral edges of the hamper's sides and the upper edges of the partition, said hoop and loop strip fasteners on the hamper's sides and the partition being adapted to engage the vertical and horizontal hoop and loop strip fasteners on the mesh bag to hold the mesh bag within the compartment.

2. The clothes hamper apparatus of claim 1, also including a tab attached to the mesh bag and extending upwardly to thereby permit the gripping the tab and the pulling of the bag upwardly to detach the bag from the hamper's compartment.

3. The clothes hamper apparatus of claim of claim 1, also including an additional vertically disposed track system mounted substantially at the midsection of one of the hamper's side walls; and a track system on the partition vertically aligned with said additional track system on the partition's wall; and a second partition slidably insertable into the additional vertical disposed track system on the midsection of the hamper's side wall and the track system on the partition whereby two additional compartments are formable within one of said compartments the hollow hamper.

* * * * *